US008312749B2

(12) United States Patent
Tong

(10) Patent No.: US 8,312,749 B2
(45) Date of Patent: Nov. 20, 2012

(54) LOCK AND KEY MECHANISM AND METHOD OF USE

(75) Inventor: Mike Yueh-Ming Tong, Bellevue, WA (US)

(73) Assignee: GMS Industries, Inc., Redmond, WA (US)

( * ) Notice: Subject to any disclaimer, the term of this patent is extended or adjusted under 35 U.S.C. 154(b) by 666 days.

(21) Appl. No.: 12/552,611

(22) Filed: Sep. 2, 2009

(65) Prior Publication Data

US 2011/0048084 A1 Mar. 3, 2011

(51) Int. Cl.
*E05B 15/06* (2006.01)
*E05B 27/00* (2006.01)

(52) U.S. Cl. ..... 70/420; 70/367; 70/375; 70/398; 70/413; 70/453; 70/493

(58) Field of Classification Search ..... 70/367, 70/373, 375, 376, 398, 413, 420, 423, 427, 70/453, 454, 490–493
See application file for complete search history.

(56) References Cited

U.S. PATENT DOCUMENTS

| | | | | | |
|---|---|---|---|---|---|
| 2,059,129 | A | * | 10/1936 | Maxwell et al. | 70/493 |
| 4,333,327 | A | | 6/1982 | Wake | |
| 4,380,162 | A | | 4/1983 | Woolfson | |
| 4,683,740 | A | * | 8/1987 | Errani | 70/419 |
| 5,050,412 | A | | 9/1991 | Errani | |
| 5,136,869 | A | * | 8/1992 | Best | 70/369 |
| 5,272,895 | A | * | 12/1993 | Best | 70/369 |
| 5,778,712 | A | * | 7/1998 | Wallden | 70/453 |
| 5,845,525 | A | * | 12/1998 | Widen | 70/493 |
| 5,946,957 | A | * | 9/1999 | Yamamoto et al. | 70/423 |
| 6,125,674 | A | | 10/2000 | Aramburu | |
| 6,615,628 | B2 | * | 9/2003 | Lou | 70/409 |
| RE39,364 | E | * | 10/2006 | Brandt | 70/419 |
| 7,681,425 | B2 | * | 3/2010 | Teixeira | 70/367 |
| 2004/0163433 | A1 | | 8/2004 | Armstrong et al. | |

FOREIGN PATENT DOCUMENTS

EP 1355023 A1 10/2003

OTHER PUBLICATIONS

Han Fey, Dom ix Dimple Key System, Feb. 2005 pp. 1-15.
Korean Intellectual Property Office; Patent Cooperation Treaty International Search Report; May 4, 2011; for International Application No. PCT/US2010/047332; Korea.

* cited by examiner

*Primary Examiner* — Christopher Boswell
(74) *Attorney, Agent, or Firm* — Davis Wright Tremaine LLP; Michael J. Donohue

(57) ABSTRACT

A lock and key mechanism reduces exposure to lock picking by including an extension into a key slot to receive and conceal tapered end portions of key pins. The only portions of key pins exposed in a key slot are cylindrical portions that are difficult to move from a resting position. A key includes a beveled leading edge and a spring-loaded pin activation element at the leading edge of the key. As the key is inserted into the key slot, the spring-loaded pin activation element is compressed to permit entry into the key slot. As the pin activation element reaches a pin, an aperture in the extension allows the spring-loaded pin activation element to move toward the key pin and move the key pin from its resting position. In this activated position, the tapered end portion of the key pin is exposed for further activation by the beveled leading edge of the key. The process is repeated until the pin activation element engages and activates each successive key pin and allows full insertion of the key.

34 Claims, 14 Drawing Sheets

19
102
106
133
130
132
S
N
164
160
158
138
154
108
110
120
122
118

LOCK AND KEY MECHANISM AND METHOD OF USE

BACKGROUND OF THE INVENTION

1. Field of the Invention

The present invention is directed generally to a lock mechanism and corresponding key.

2. Description of the Related Art

Lock and key mechanisms have existed relatively unchanged for hundreds of years. While improvements have been made, the fundamental concept remains the same. That is, a pin-tumbler lock cylinder mechanism has a rotating cylinder mechanism in which pins are positioned to prevent the rotation thereof. When the appropriate key is inserted into the lock, the pattern on the key positions the pins in the cylinder at an appropriate location that permits rotation of the cylinder along with the key. Unfortunately, the pins in a conventional lock are relatively exposed and thus susceptible to lock picking. Therefore, it can be appreciated that there is a significant need for an improved lock and key mechanism that provides greater security. The present disclosure describes such a mechanism, which provides this and other advantages as will be described in the detailed description and accompanying figures.

BRIEF DESCRIPTION OF THE SEVERAL VIEWS OF THE DRAWING(S)

DETAILED DESCRIPTION OF THE INVENTION

Figure 1:
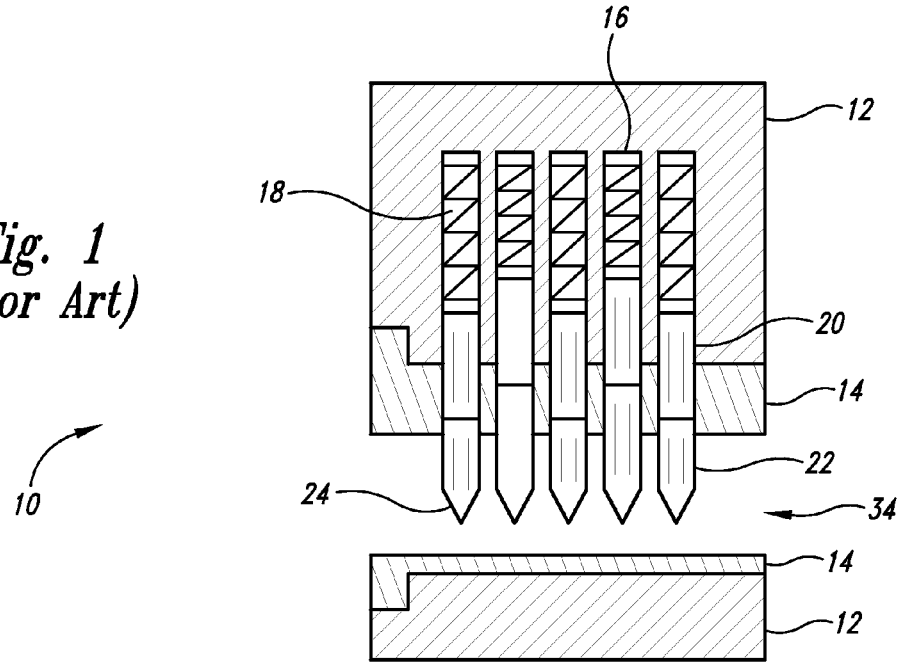
Fig. 1 (Prior Art)
FIG. 1 is a side cut-away view of a pin tumbler lock cylinder mechanism without a key.
Figure 2:
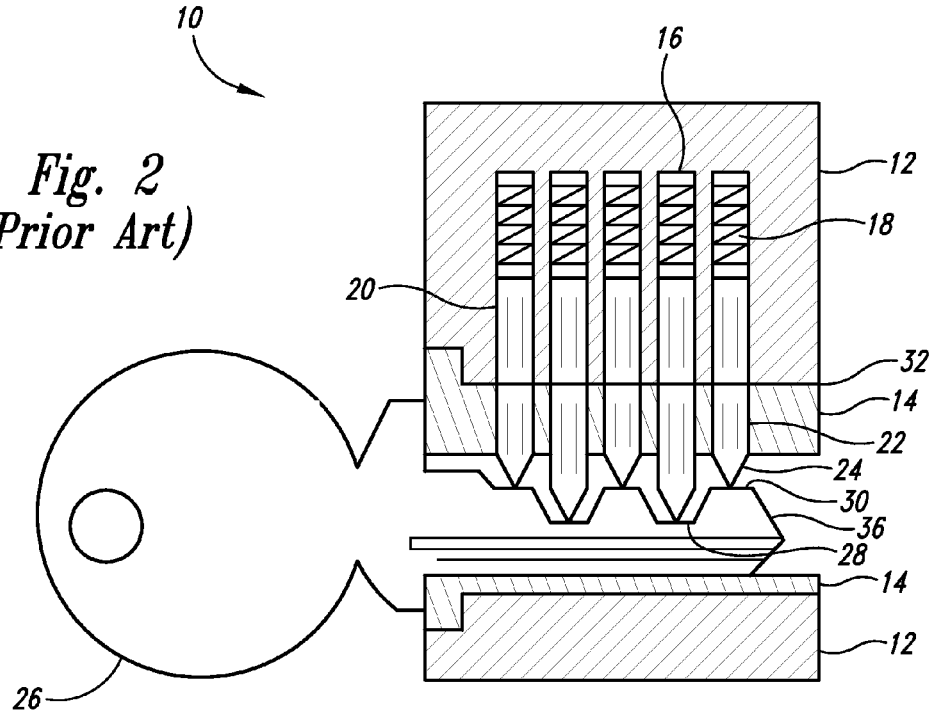
Fig. 2 (Prior Art)
FIG. 2 is a side cut-away view of the conventional pin-tumbler lock cylinder mechanism of FIG. 1 with a key inserted.

A conventional lock and key mechanism is illustrated in FIGS. 1-2. A lock 10 comprises a hull 12 and a plug 14. A plurality of holes 16 are bored into the hull 12 and plug 14. Within each hole 16 is a spring 18, a driver pin 20 abutting the spring 18 at one end, and a key pin 22 abutting the driver pin 20 at the end of the driver pin 20 opposite the spring. Although other shapes are possible, the holes 16, driver pins 20 and key pins 22 are generally circular in cross-section. The driver pins 20 are generally cylindrical in shape with all driver pins having identical lengths. In some embodiments, the cylinders have different driver pin lengths such that, at rest, the combined stacks of driver pins 20 and key pins 22 are the same overall length. In this manner, the springs 18 are compressed by the same amount while at rest. The key pins 22 are generally cylindrical in shape at the end that abuts the corresponding driver pin 20. The opposite end of the key pin 22 is generally a tapered end portion 24 whose function will be described in greater detail below.

The key pins 22 have different lengths. When no key is inserted into the lock 10, the springs 18 bias the driver pins 20 and key pins 22 toward the plug 14. As a result, the driver pins 20 are positioned partly within the holes 16 in the hull 12 and partly within the holes 16 in the plug 14. Because the driver pins 20 extend between the hull 12 and the plug 14, the plug 14 cannot rotate and the lock 10 is locked.

As illustrated in FIG. 2, a key 26 has a series of notches 28 or ridges 30 that correspond to the position of the key pins 22. When the proper key is inserted, as illustrated in FIG. 2, the notches 28 and ridges 30 of the key 26 position the key pins 22 so that the top of the key pins 22, and the bottom of the driver pins 20, are all aligned at the junction between the hull 12 and the plug 14. This junction is referred to as a shear line 32. When the proper key 26 is inserted into the lock 10, the driver pins 20 and key pins 22 align at the shear line 32 and allow the plug 14 to rotate within the hull 12.

If an improper key is used, some of the driver pins 20 and key pins 22 may align at the shear line 32, but at least one of the driver pin 20/key pin 22 pairs will not align thus preventing the plug 14 from rotating within the hull 12.

As seen in FIG. 1, the tapered end portions 24 of the key pins 22 extend downward into a key slot 34 for engagement by the key 26. In operation, the key 26 has a sloped leading edge 36, which is angled to engage the tapered end portions 24 of the key pins 22 and push the key pins out of their resting position. The key 26 sequentially engages the key pins 24 as the key is inserted into the plug 14. Thus, the key pins 22 ride up and down on the notches 28 and ridges 30 of the key 26 as the key is inserted. When the proper key 26 is fully inserted into the plug 14, the notches 28 and ridges 30 of the key 26 position the key pins 22 such that the key pins 22 and driver pins 20 are aligned at the shear line 32, as described above.

The protrusion of the tapered end portions 24 of the key pins 22 into the key slot 34 presents a vulnerability. These exposed key pins 22 may be manipulated by lock picking instruments to force the key pins into alignment at the shear line 32 and thus allow the lock to be "picked" even without the use of the proper key 26.

Figure 3:
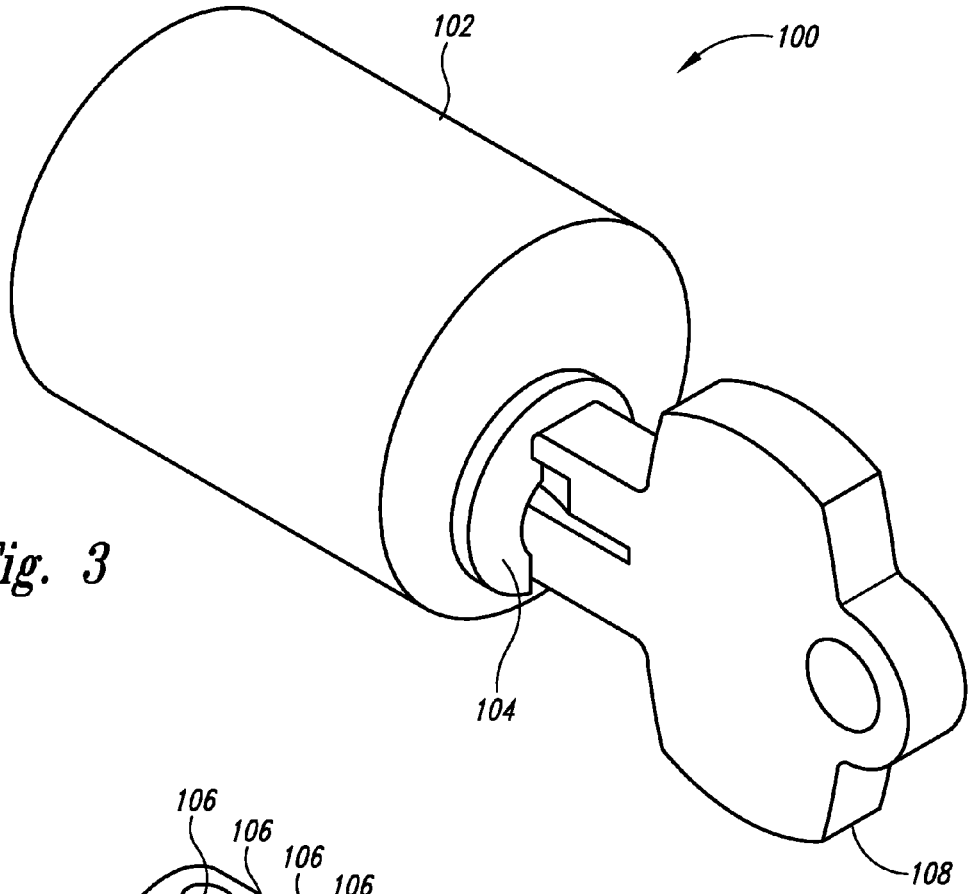
FIG. 3 is a front perspective view of a lock and key mechanism constructed in accordance with the present teachings.
Figure 4:
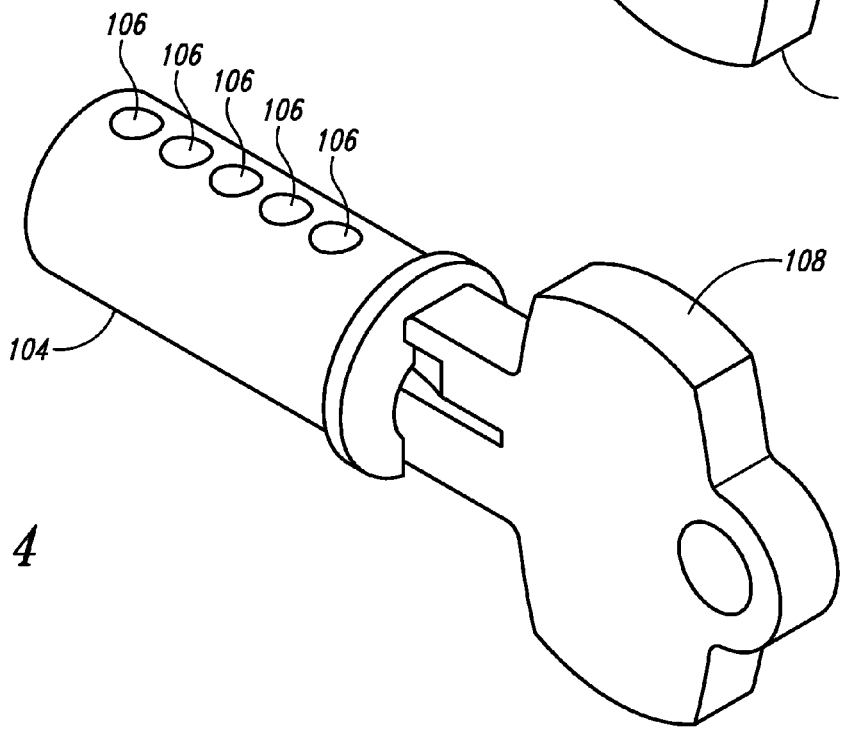
FIG. 4 is a front perspective view of the key of FIG. 1 and the key plug.

The lock and key mechanism described herein greatly reduces or eliminates the exposure of key pins to potential lock picking instruments and thus provides a greater level of security than a conventional lock. FIG. 3 illustrates a front perspective view of a lock 100 constructed in accordance with the present teachings. For the sake of clarity, the lock 100 is shown without installation into a door or other location in which a lock would be installed. The lock 100 includes a hull 102 and a rotating member, which may be referred to as a rotating plug or cylinder 104. FIG. 4 is a front perspective view of the plug 104 removed from the hull 102. The plug 104 contains a series of holes or apertures 106. The lock 100 may contain greater or fewer than the 5 holes 106 illustrated in FIG. 2. Operational details of the holes 106 will be provided below. In FIGS. 3-4, a key 108 is shown in its fully inserted position.

Figure 5:
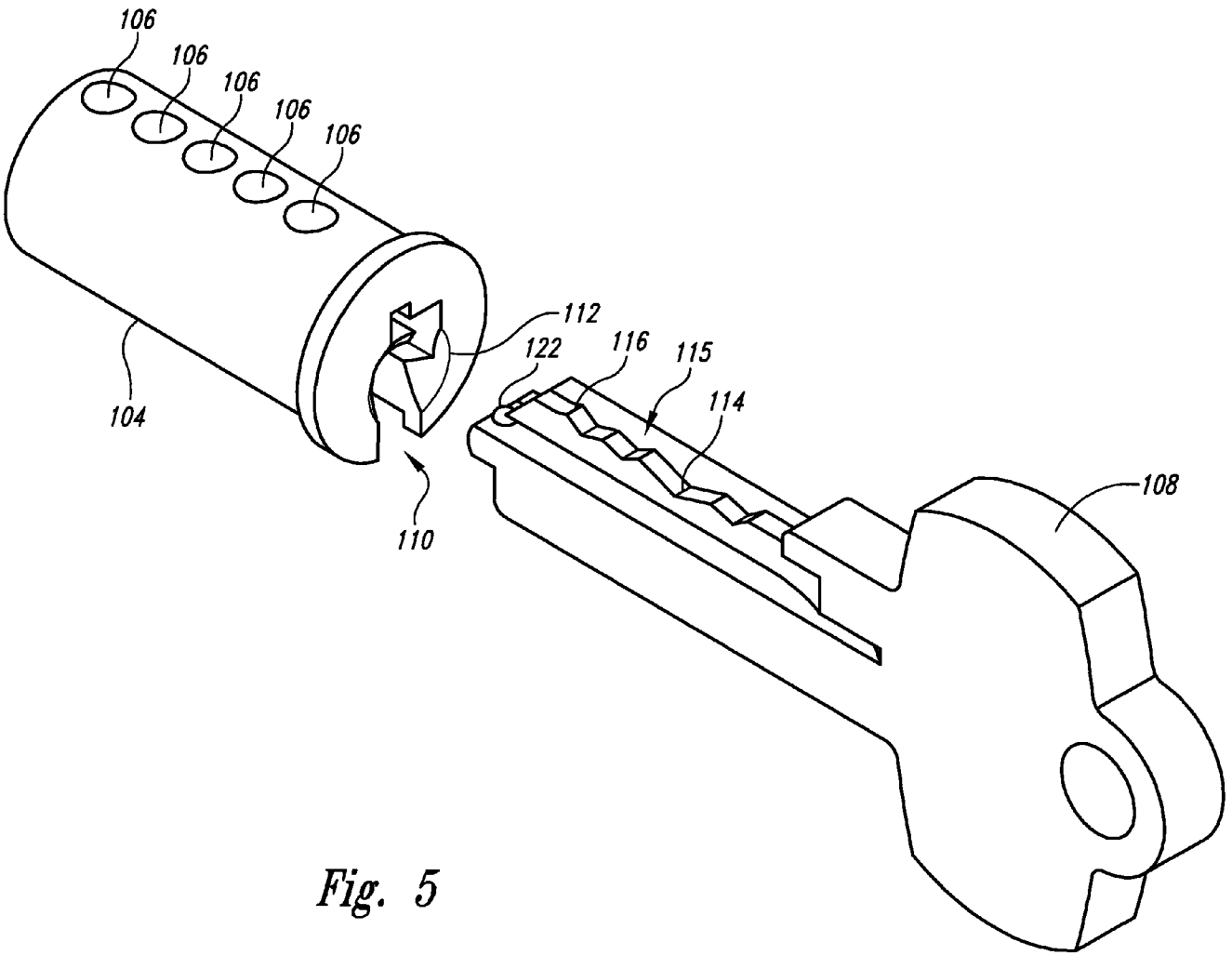
FIG. 5 is a front perspective view of the key and plug of FIG. 4 with the key removed therefrom.

FIG. 5 is a front perspective view of the plug 104 with the key 108 removed. As can be seen in FIG. 5, a key slot 110 is manufactured in a shape that only permits insertion of a key (i.e., the key 108) having a shape and size to match the key slot 110. A key guide 112 is a shallow depression that guides the key 108 into the key slot 110.

The key 108 contains a series of notches 114 and ridges 116 arranged on a pin positioning surface 115 along a longitudinal axis of the key. When the proper key 108 is fully inserted into the plug 104, pins align at a shear line 118 (see FIG. 9) and allow rotation of the plug 104 within the hull 102.

Figure 6:
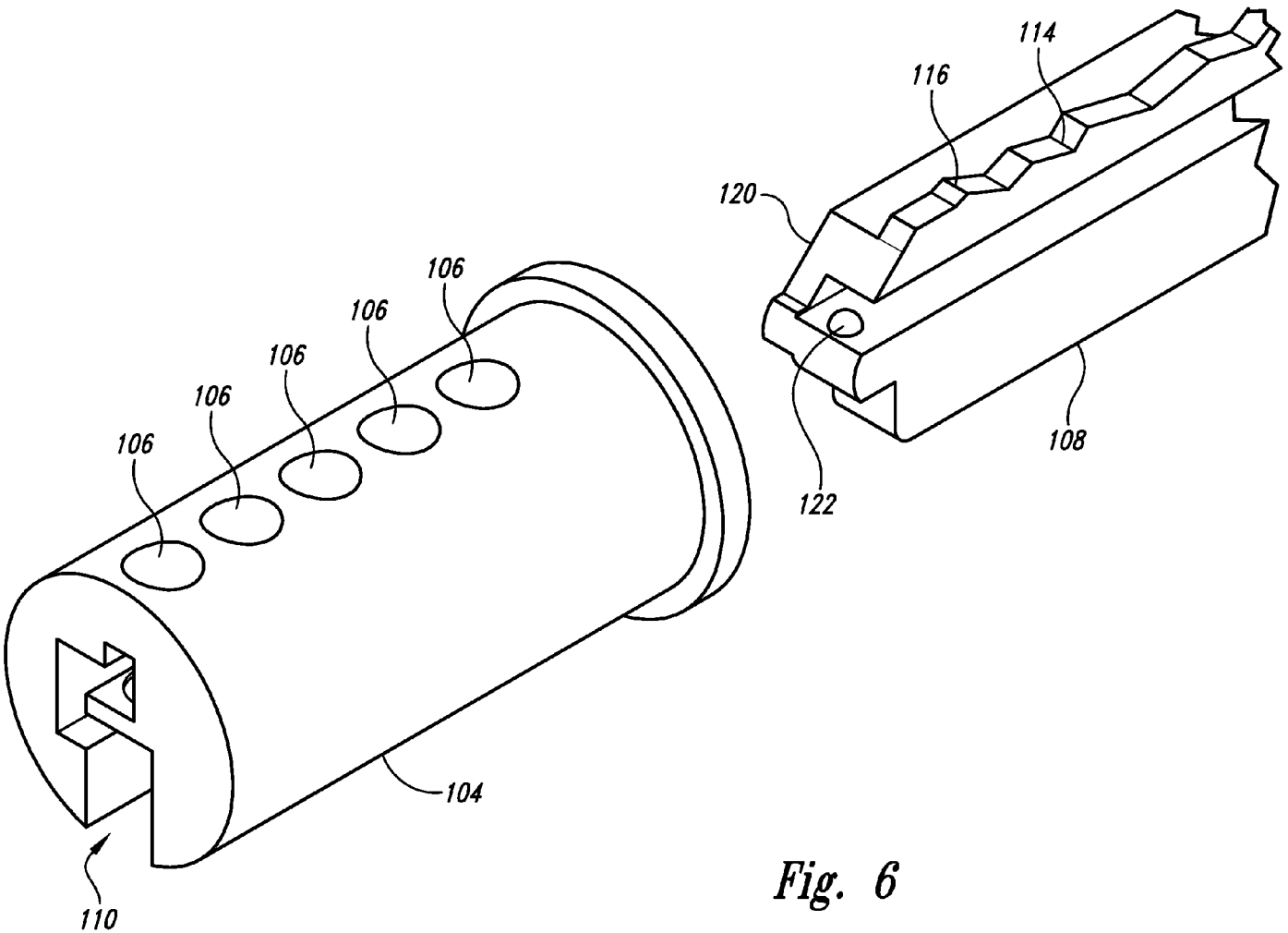
FIG. 6 is a rear perspective view of the key and plug of FIGS. 4-5.

FIG. 6 is a rear perspective view of the plug 104 and key 108. As best seen in FIG. 6, the key 108 has a beveled or sloped leading edge 120 and a pin activation element 122. The operation of the leading edge 120 and pin activation element 122 will be discussed in greater detail below.

Figure 7:
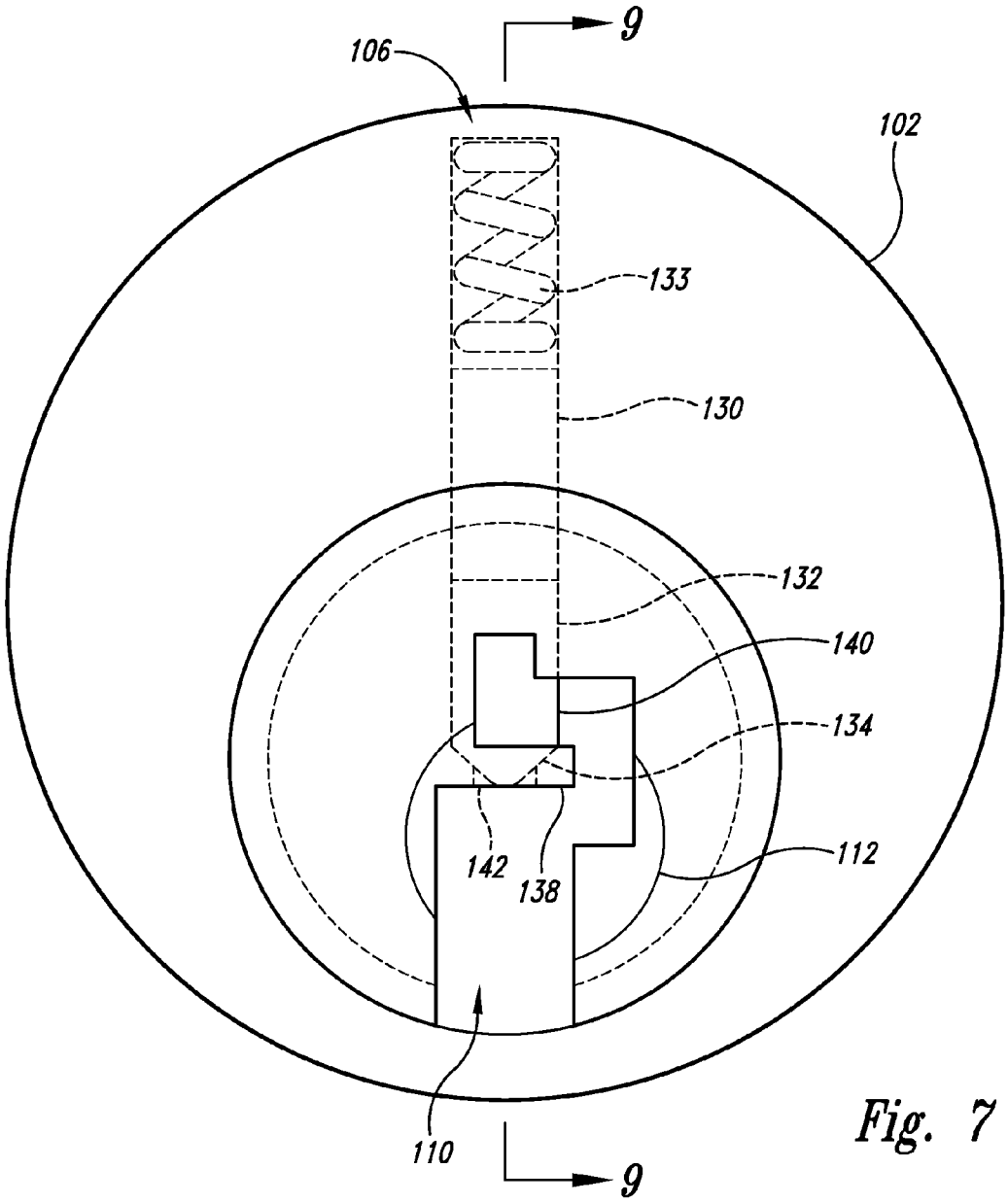
FIG. 7 is a front elevation view of the key plug of FIGS. 4-6.

FIG. 7 is a front elevation view of the plug 104 and more clearly illustrates the key slot 110. FIG. 7 also illustrates, in phantom, a driver pin 130 and a key pin 132. Springs 133 are positioned within the holes 106 in the hull 102 behind each driver pin 130 and operate in a conventional manner as do the springs 18 in FIGS. 1-2. In an exemplary embodiment, the springs are coil springs. However, other forms of a resilient member may be used in place of coil springs. The springs 133 bias the driver pins 130 and key pins 132 toward the key slot 110.

Because FIG. 7 is a front elevation view, the driver pin 130 and key pin 132 illustrated in FIG. 7 are the first driver pin and key pin encountered by the key 108. Thus, the driver pin 130 and key pin 132 illustrated in FIG. 7 are referred to as "pin one."

Figure 9:
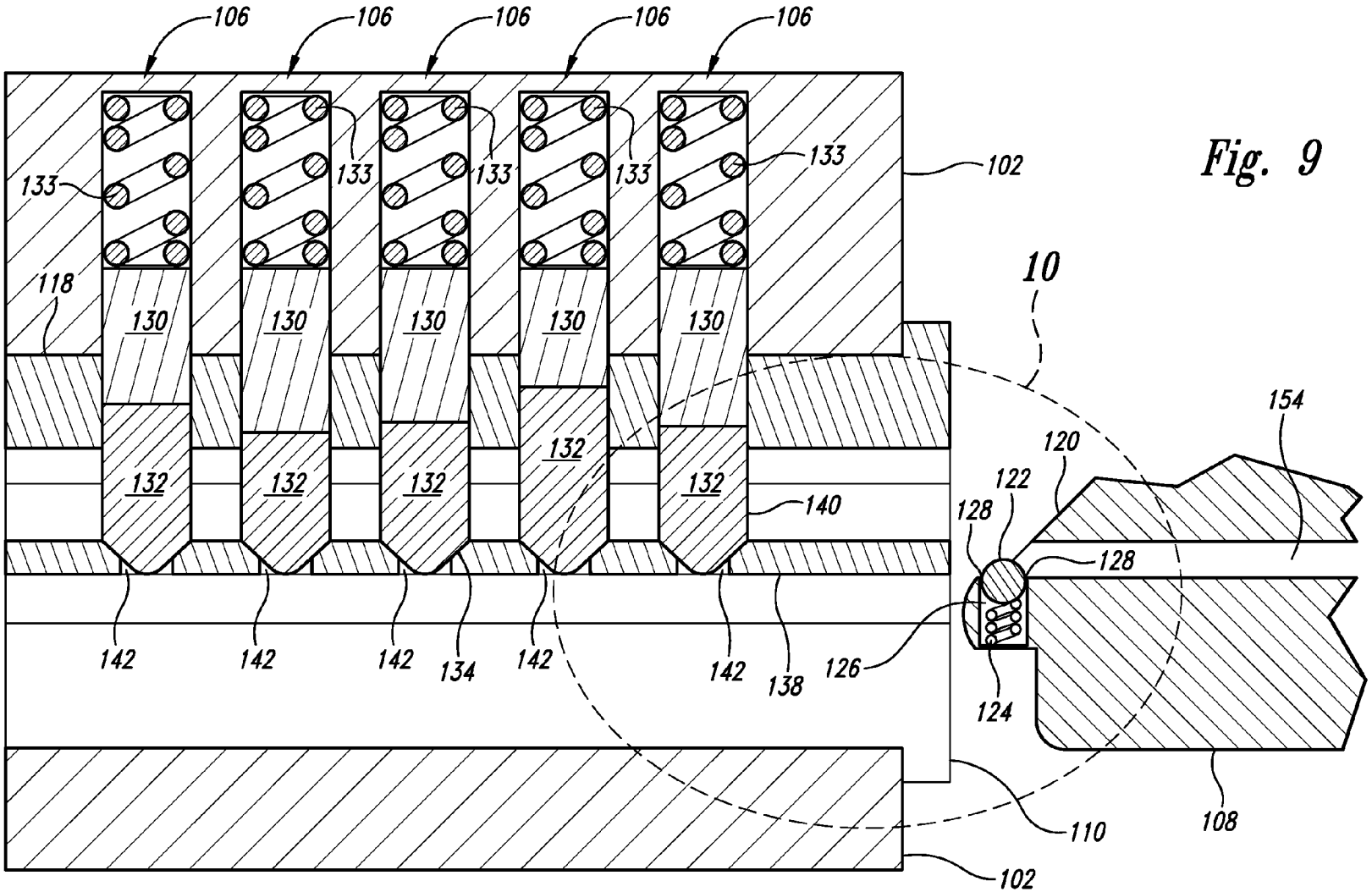
FIG. 9 is a cut-away view of the plug and key designed in accordance with the present teachings.
Figure 10:
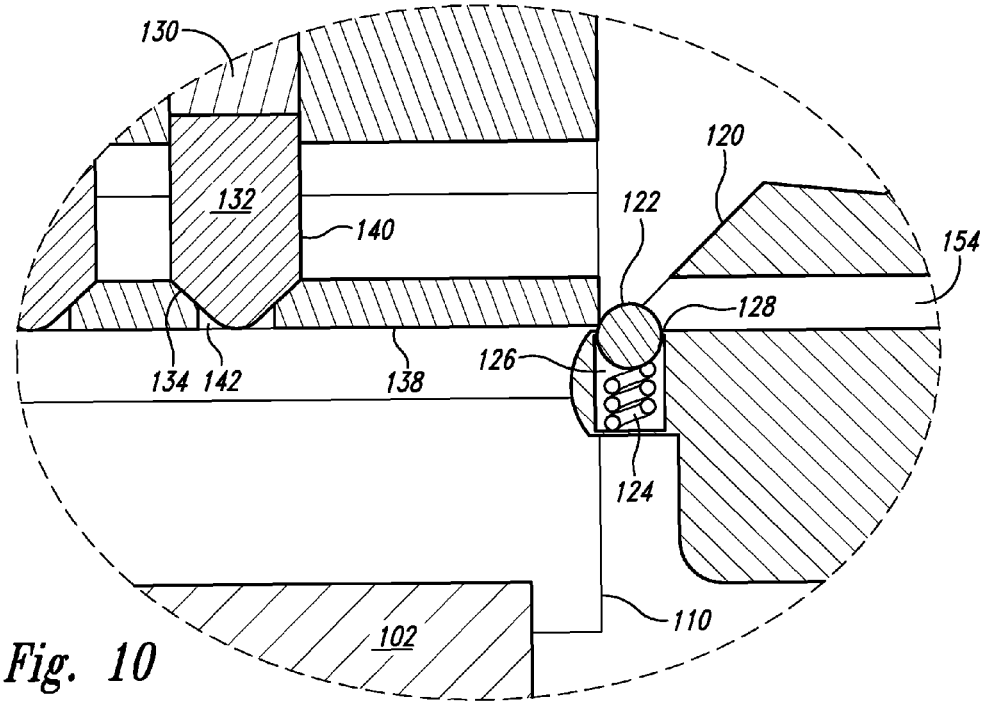
FIGS. 10-14 are close-up cut-away views of the plug and key designed in accordance with the present teachings as the key is inserted into the plug.

In an exemplary embodiment, the driver pins 130 are cylindrical in shape with flat end portions at opposing ends of the cylinder. In one embodiment, the driver pins 130 are of uniform length. Alternatively, the driver pins 130 may also vary in length such that the combination of the driver pins and key pins have a uniform length. In this embodiment, the springs 133 are compressed by the same amount while at rest, as illustrated in FIG. 9.

In an exemplary embodiment, the key pins 132 are also generally cylindrical in shape with a flat end portion abutting one end portion of the driver pin 130. The opposite end of the key pin 132, distal from the driver pin 130, comprises a generally tapered end portion 134. While the tapered end portion 24 of the conventional lock (see FIGS. 1-2) extends into the key slot 34, the tapered end portion 134 of the lock 100 is not similarly exposed.

As illustrated in FIG. 7, the key slot 110 includes an extension member 138 that serves to conceal the tapered end portions 134 of the key pins 132. The extension 138 extends from one side of the plug 104 into the key slot 110. For ease in manufacturing, the extension 138 may extend through the length of the plug 104. However, this is not necessary for satisfactory operation of the mechanism 100. The extension 138 must extend along a longitudinal axis of the plug 104 to allow the extension to interact with the key pins 132 in a manner described below. The extension 138 provides a stop for the tapered end portions 134 of the key pin 132. In addition to providing a resting position for the tapered end portions 134 of the key pins 132, the extension 138 serves to conceal the tapered end portions from view within the key slot 110.

As will be discussed in greater detail below, the extension 138 in the key slot 110 contains a series of indentations sized to receive the tapered end portion 134 of the key pins 132. As illustrated in FIG. 7, the tapered end portions 134 of the key pins 132 are shown in a resting position and fully concealed. That is, the tapered end portions 134 are not visible in the key slot 110. Thus, the only portion of the first key pin 132 exposed in the key slot 110 is a cylindrical body portion 140. Exposure of only the cylindrical body portion 140 of the first key pin 132 makes it much more difficult for a lock picking instrument to move the key pin 132 and, therefore, makes lock picking much more difficult.

Figure 8:
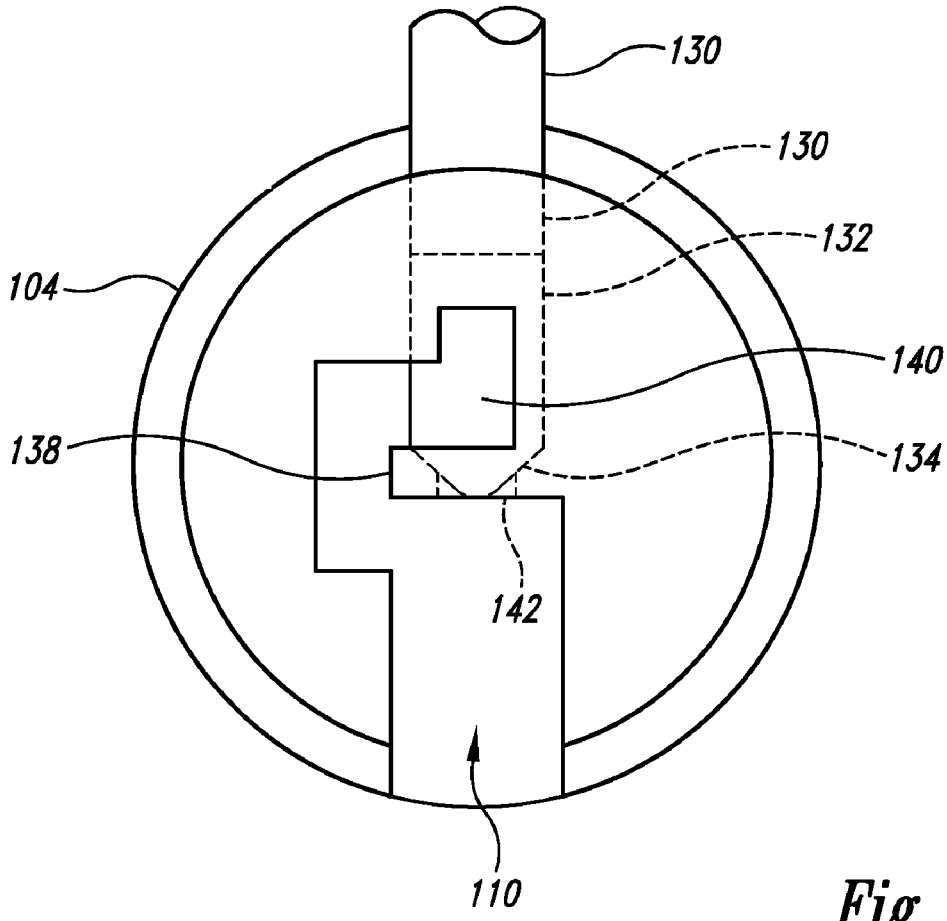
FIG. 8 is a rear elevational view of the key plug of FIG. 7.

FIG. 8 is a rear elevation view of the plug 104 and illustrates, in phantom, a fragmentary portion of the final driver pin 130 and the key pin 132. As discussed above with respect to FIG. 7, the tapered end portion 134 of the key pin 132 is shown in its resting position within the extension 138 and thus not exposed within the key slot 110.

FIGS. 9-14 are cut-away views of the plug 104 and key 108 to illustrate the sequence of operation as the key 108 is inserted into the key slot 110. FIGS. 9-14 are taken along the line 9-9 shown in FIG. 7. For the sake of clarity in understanding the operation, the drawings are not to scale. For example, the dimensions of the key pins, such as length and diameter, are not drawn to scale.

The holes 106 are generally cylindrical in shape and sized to slideably retain the driver pins 130 and key pins 132. The tapered end portions 134 of the key pins rest within the extension 138.

Figure 14:
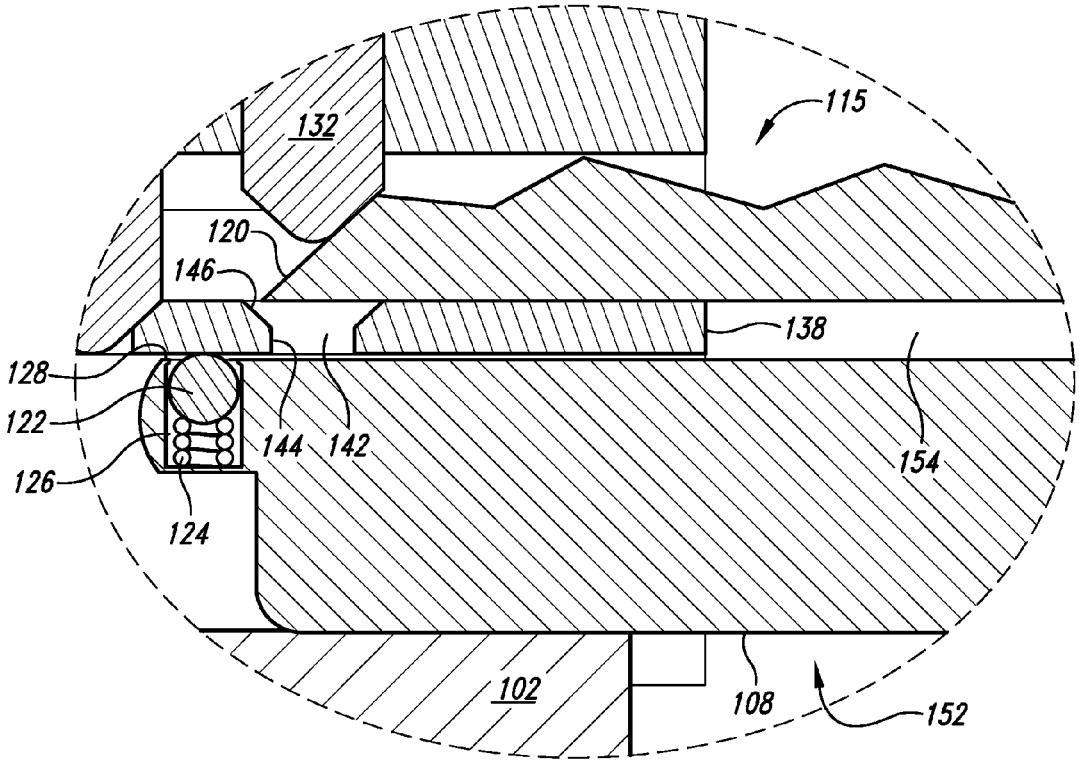

In an exemplary embodiment, the extension 138 contains an aperture 142 sized to receive the tapered end portion 134 and serve as a stop for the key pin 132 when the key 108 is not inserted into the lock 100. As best illustrated in FIG. 14, the aperture 142 has a cylindrical portion 144 and a tapered portion 146. The tapered portion 146 may be angled to correspond to the shape of the tapered end portion 134 of the key pin 132. When the key 108 is removed from the lock 100, the tapered end portions 134 of the key pins 132 are fully seated within the tapered portion 146 of the aperture 142 such that the tapered end portion of the key pin does not extend into the key slot 110.

Returning again to FIG. 9, the beveled leading edge 120 of the key 108 and the pin activation element 122 are also shown in cross-section. In an exemplary embodiment, the pin activation element 122 may be a cylindrical ball. In one embodiment, a steel ball bearing, having sufficient hardness, may be used to implement the pin activation element 122. A resilient member 124, such as a spring, is positioned within a shaft 126 in the key 108 to urge the pin activation element 122 in a direction transverse to the longitudinal axis of the key. The resilient member 124 is housed within the shaft 126 with a closed end and an open end 128 having an opening diameter slightly smaller than the diameter of the pin activation element 122. The reduced size of the opening 128 serves to retain the pin activation element 122 within the shaft 126.

The pin activation element 122 can be manufactured as part of the key 108 by drilling a shaft from the bottom such that the open end 128 is slightly smaller than the diameter of the pin activation element 122. A small spring can be inserted as the resilient member 124 and a cap (not shown) pressed in from the bottom to fill the hole. The mechanical assembly comprising the pin activation element 122 and the resilient member 124 may be manufactured separately from the key. A thin-walled cylinder can be manufactured to house a coil spring and a steel ball bearing retained therein. This assembly may be press-fit into a hole at the leading edge of the key 108.

Figure 11:
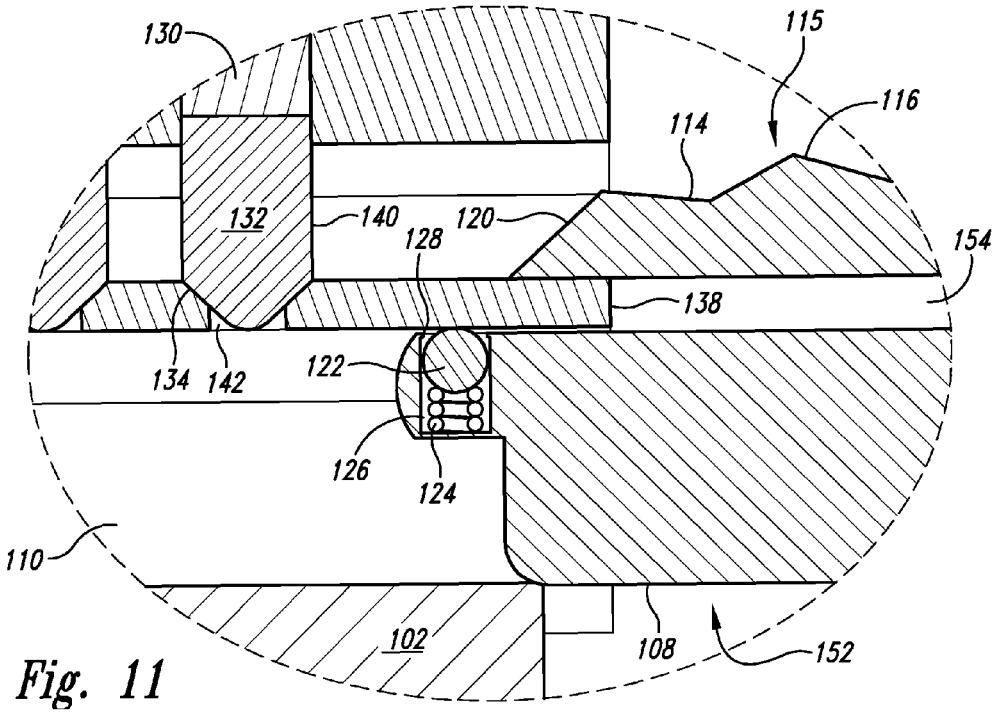

FIGS. 10-14 are magnified views of the portion of FIG. 9 illustrated by the dashed line 10. As the key 108 is inserted into the key slot 110, the pin activation element 122 encounters the extension 138. Due to the spring-loaded nature of the pin activation element 122 and resilient member 124, the pin activation element is compressed sufficiently to permit the key 108 to slide into the key slot 110, as illustrated in FIG. 11.

Figure 12:
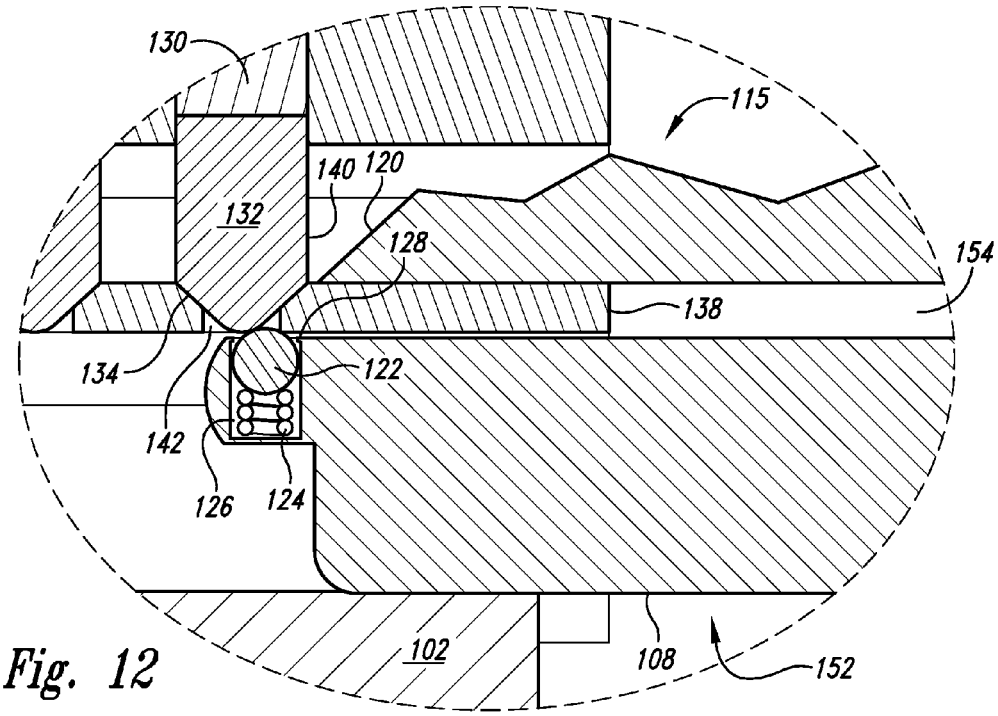

FIG. 12 illustrates the sequence of operation as the pin activation element 122 approaches the cylindrical portion 144 of the aperture 142 in the extension 138.

Figure 13:
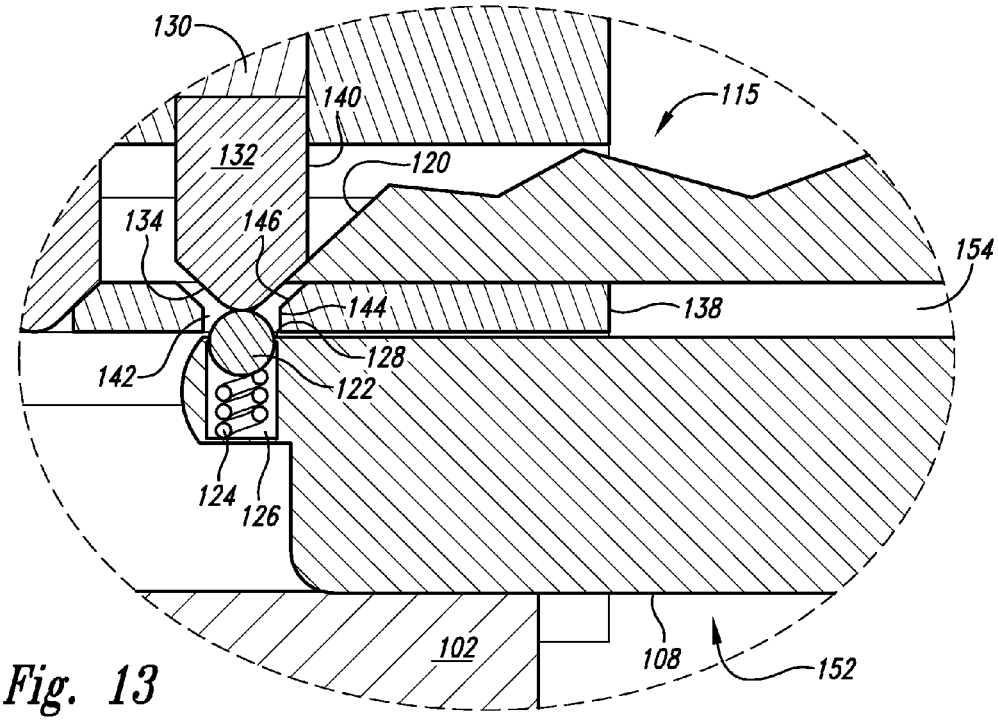

In FIG. 13, the pin activation element 120 is fully aligned with the cylindrical portion 144 of the aperture 142 such that the extension 138 no longer compresses the pin activation element 122. The resilient member 124 urges the pin activation element 122 toward the key pin 132 thereby lifting the key pin from its resting position. The precise force exerted by the resilient member 124 is not critical, but it must generate a sufficient force to overcome the force generated by the spring 133 that tends to push the drive pins 130 and key pins 132 toward the aperture 142. As illustrated in FIG. 13, the operation of the pin activation element 122 lifts the key pin 132 out of its resting position thereby exposing the tapered end portion 134 within the key slot 110 for engagement with the beveled leading edge 120 of the key 108.

In the absence of the pin activation element 122, the beveled leading edge 120 of the key 108, or a beveled leading edge of any key, would encounter the cylindrical body portion 140 of the key pin 132. The leading edge of the key simply jams into the cylindrical body portion 140, but cannot lift the key pin 132 from its resting position.

In contrast, the pin activation element 122 serves to lift the key pin 132 from its resting position to thereby expose the tapered end portion 134 for engagement and further lifting by the beveled leading edge 120 of the key 108. After the initial activation of the key pin 132, as illustrated in FIG. 13, the key pin will follow the notches 114 and ridges 116 of the key 108 in a conventional manner.

As the key 108 is further inserted into the key slot 110, the pin activation element 122 encounters the extension 138 again and is compressed by the extension to thereby permit further insertion of the key 108, as illustrated in FIG. 14. The pin activation element 122 sequentially encounters each cylindrical portion 144 of subsequent apertures 142. The pin activation element 122 is urged upward by the resilient member 124 to contact the tapered end portions 134 of the key pins 132, thereby urging the subsequent key pins from their resting position and permitting engagement with the beveled leading edge 120 of the key 108.

When the proper key 108 is fully inserted within the key slot 110, the pin activation element 122 will have successfully engaged and activated each sequential key pin 132. If the proper key is inserted, the top of the key pins 132 (and the bottoms of the corresponding driver pins 130) will all be in alignment at the shear line 118 to thereby permit the plug 104 to rotate within the hull 102.

Thus, the arrangement of the key pins 132 within the extension 138 prevents exposure of the tapered end portion 134 within the key slot 110. It is only when the proper key 108 is inserted and the pin activation element 122 sequentially encounters the bottom portion of each key pin 132 that the spring-loaded pin activation element extends from the key 108 to lift the key pin 132 from its resting position and expose the tapered end portion 134 of the key pin to the beveled leading edge 120 of the key 108.

Figures 15, 16:
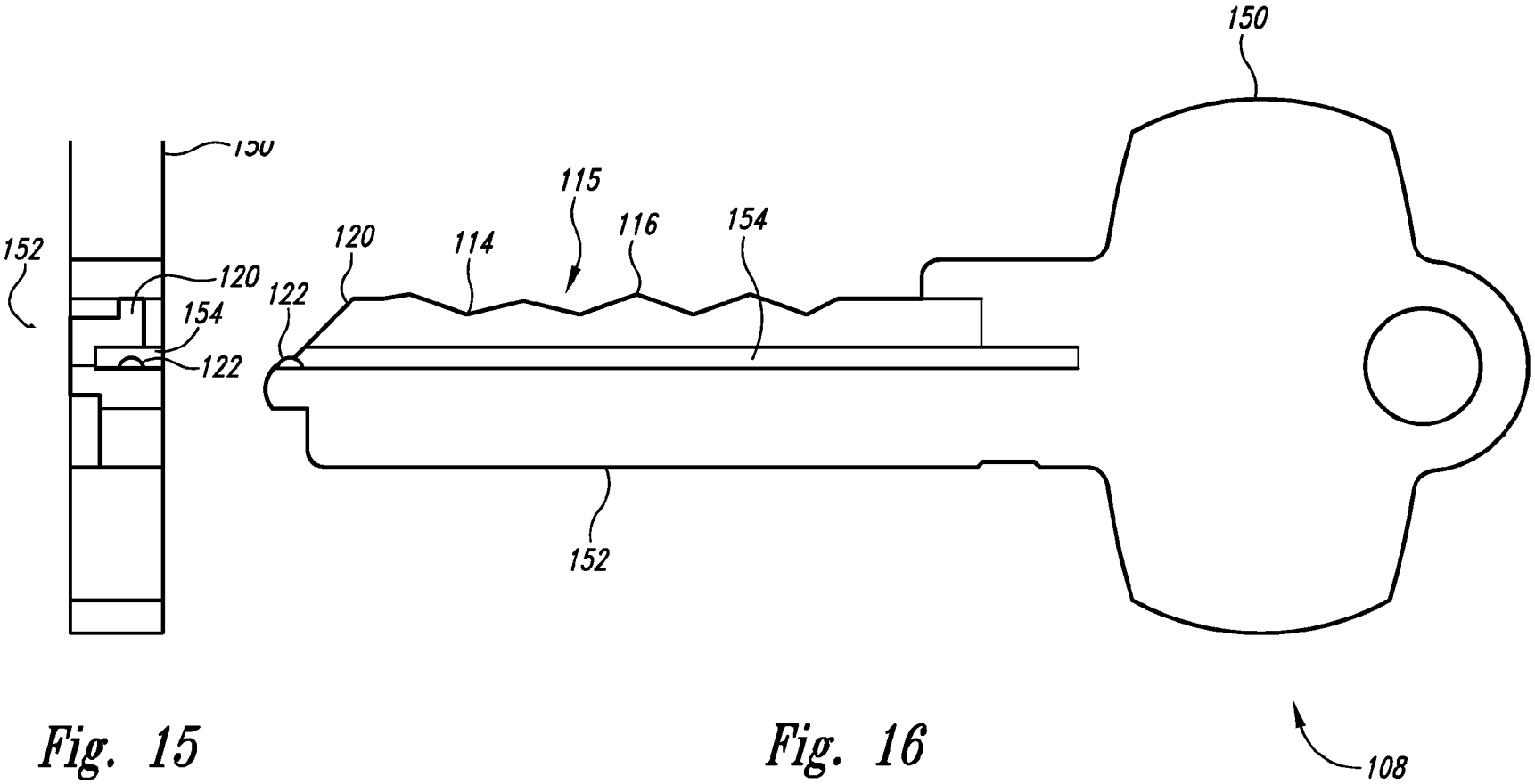
FIG. 15 is a front elevation view of a key designed in accordance with the present teachings.
FIG. 16 is a side elevation view of the key of FIG. 15.

Additional details of the key 108 are provided in FIGS. 15 and 16. The key 108 comprises a handle portion 150 and an insertion portion 152. The handle portion 150 is enlarged for easy grasping by a user to insert the key into the key way 110, rotate the key within the lock 100 and to remove the key from the lock. The elongated insertion portion 152 is attached to the handle portion 150 and has a size and shape corresponding to the key way 110. In particular, the insertion portion 152 has a groove 154 having a shape corresponding to the extension member 138 (see, e.g., FIG. 7) such that groove 154 slides along the extension 138 as the key 108 is inserted into the key way 110. As described above, the activation element 122 is compressed as the groove 154 of the insertion portion 152 slides along the extension 138. As the activation element 122 reaches the aperture 142 (see FIG. 13) the resilient member 124 causes the activation element 122 to pop up into the aperture 142 thereby lifting the corresponding key pin 132 out of its resting position and exposes the tapered end portion 134 for engagement by the leading edge 120 with the key 108.

Although the extension member 138 is shown in rectangular form and corresponds to the shape of the groove 154 in the key 108, other matching shapes could be used for the extension member and groove. For example, the extension member may have a planar upper surface with apertures 142 as described above and a rounded lower surface. In this embodiment, a lower surface of the groove 154 (see FIG. 16) may be configured in a shape and size to correspond to the extension 138. Thus, the lock 100 and key 108 are not limited by the specific shape of the extension 138.

Figure 17:
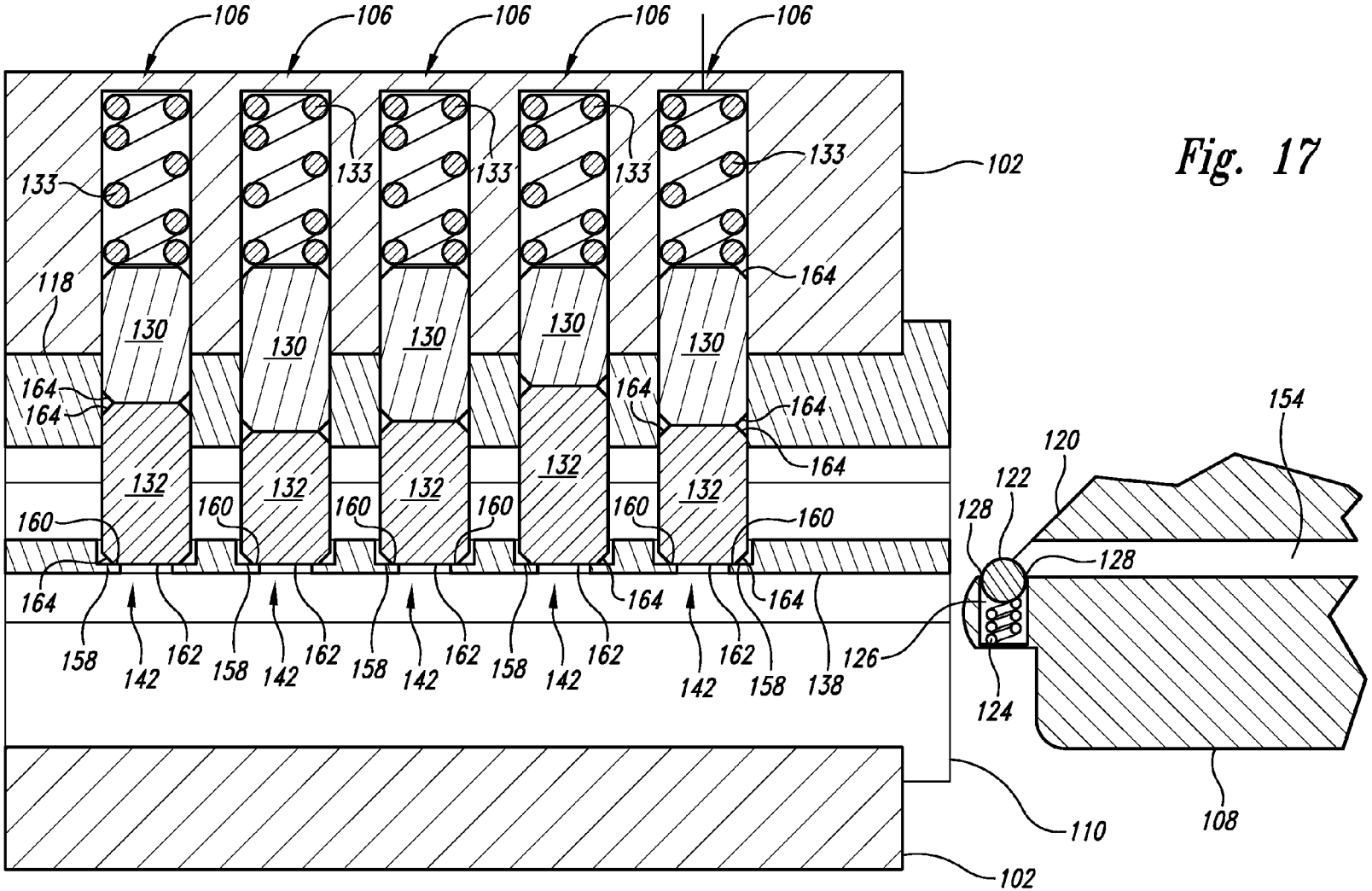
FIG. 17 is a cut-away view of the plug and key in an alternative embodiment to that illustrated in FIG. 9.

In the embodiments illustrated in FIGS. 9-14, the key pins are implemented with the tapered end portion 134. In an alternative embodiment illustrated in FIG. 17, the key pins 132 need not have the tapered end portion 134, but have a flat end portion 162.

In an exemplary embodiment, the flat end portion 162 may have a chamfered or beveled edge 164. Other forms of smoothing the edges, such as rounding, may also be used. The chamfered edge 164 at the end of the driver pin 130 that abuts the key pin 132 and the chamfered edge 164 at the end of the key pin that abuts the driver pin help prevent binding when the key is inserted and these ends of the driver pins and key pins are brought into alignment at the shear line 118. Due to manufacturing tolerances, there may not be precise alignment at the shear line 118. The chamfered edges at the junction between the driver pins 130 and the key pins 132 help prevent binding of the plug 104 in the hull 102 and allow rotation of the plug. The use of chamfered edges 164 at both ends of the driver pins 130 and key pins 132 simplifies the assembly process because these pins may be inserted in either direction. Finally, the chamfered edges 164 may generally reduce the chances of binding of the driver pins 130 and/or key pins 132 in the holes 106.

In the embodiment of FIG. 7, the extension 138 includes the apertures 142, but need not include the tapered portion 146 (see FIG. 13). Instead, recesses 158 may be formed in the extension to form a resting surface 160 (see FIG. 19) for the key pins 132.

In operation, the activation element 122 is compressed by the extension 138, as illustrated in FIG. 11, and is urged into mechanical engagement with the key pin 132 when the activation element 122 is aligned with the aperture 142, as illustrated in FIG. 13. The only difference is that the activation element 122 mechanically engages the flat bottom portion 162 of the key pin 132 rather than the tapered end portion 134 shown in FIG. 13. As the key pin 132 is moved out of its resting position, the leading edge 120 of the key 108 can sequentially engage the chamfered edge 164 and the bottom portion 162 of the key pins 132 to position the key pins 132 in the manner described above.

Figure 18:
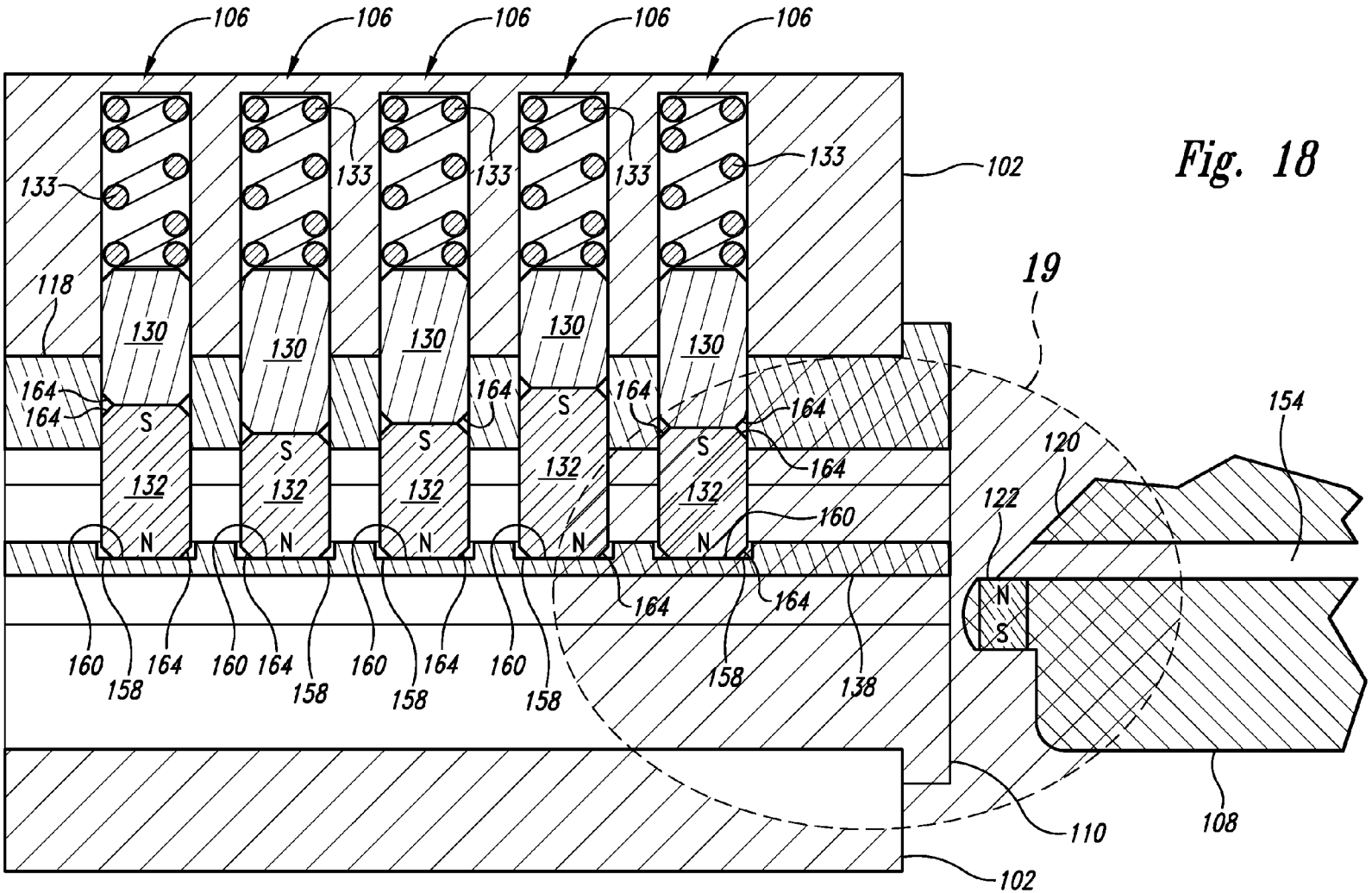
FIG. 18 is cut-away view of the plug and key in yet another alternative embodiment to that illustrated in FIG. 9.
Figure 19:
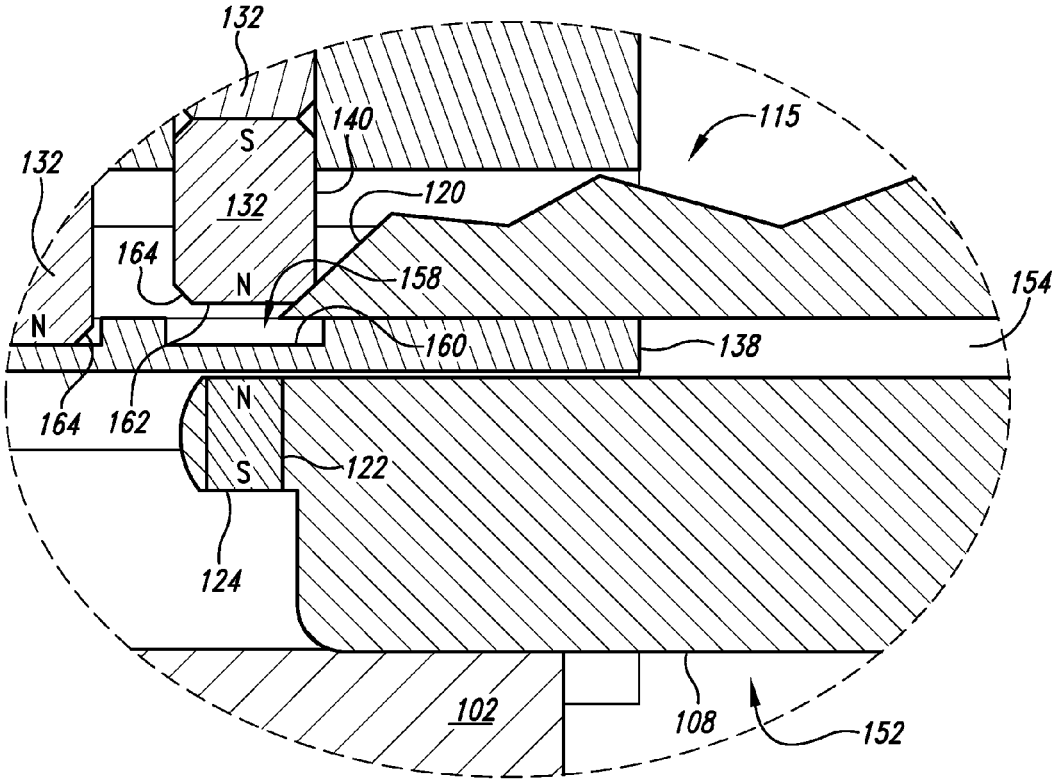
FIG. 19 illustrates the operation of the alternative embodiment illustrated in FIG. 18.

In yet another alternative embodiment, illustrated in FIGS. 18-19, the pin activation element 122 is a magnetic element. The magnetic embodiment of the pin activation element 122 may be implemented using ferro magnetic materials, a ceramic magnet, or the like. The pin activation element 122 is not limited by the specific form of the magnetic material. In this embodiment the key pins 132 are also manufactured with a magnetic material. The implementation of the key pins 132 with magnetic material may be implemented with ferro magnetic materials, ceramic magnetic materials, or the like, as described above with respect to the magnetic pin activation element 122. The implementation of the magnetic key pins 132 is not limited by the specific selection of the magnetic materials. The magnetic pole of the key pins 132 are oriented within the apertures 106 to create a magnetic repulsion with the magnetic pin activation element 122 as the magnetic pin activation element passes in proximity. In the example illustrated in FIG. 18, the magnetic pin activation element 122 has a magnetic orientation designated by North and South poles. In this example, the North pole of each of the key pins 132 is directed toward the key slot 110 such that a magnetic repulsion will be created between the magnetic pin activation element 122 and each of the key pins 132 as the magnetic activation element passes in proximity to the respective key pins. Those skilled in the art will appreciate that the amount of magnetic repulsion must be sufficient to overcome the force of the springs 133 and allow the key pins 132 to be moved from their resting position in the extension 138 to permit the bottom of the key pin to be exposed for engagement with the leading edge 120 of the key 108, as illustrated in FIG. 19.

In this embodiment, the extension 138 is manufactured from a non-magnetic material, such as brass, or a non-metal material such as plastic.

In the embodiment of FIGS. 9-14 and FIG. 17, activation of the key pins 132 occurs through physical contact of the pin activation element 122 with the key pins 132 through the apertures 142 in the extension 138. In the alternative embodiment of FIGS. 18-19, there is no need for the apertures 142 (see e.g., FIG. 13) to extend all the way through the extension 138 because activation of the key pins 132 occurs via a magnetic field coupled through the extension 138. Thus, the recess 158 need only be formed part way through the extension 138 to form a resting surface 160 for each of the key pins 132.

FIG. 18 illustrates a separate recess 158 in the extension 138 corresponding to each key pin 132. For ease in manufacturing, a single elongated recess 158 could accommodate all of the key pins 132. In this embodiment, the key pins 132 need not have the tapered end portion 134 (see e.g., FIG. 13), but have the flat end portion 162 that rests on the resting surface 160 when the key 108 is not in the plug 104. The driver pins 130 and/or key pins 132 may also include chamfered or beveled edges 164. Both opposing ends of the driver pins 130 and key pins 132 may have the chamfered edges 164 to reduce binding and for ease in assembly, as described above.

An advantage of the embodiment of FIGS. 18-19 is that the flat end portion 162 of the key pin 132 is not exposed in the key slot 110 in any manner. Thus, even a lock picking instrument cannot access the flat end portion 162 of the key pin 132 to force the lock mechanism 100. It is only upon activation by the magnetic pin activation element 122 that the key pin 132 rises up from its resting position on the resting surface 160 and exposes the flat end portion 162 for engagement with the leading edge 120 of the key 108, as illustrated in FIG. 18. In the absence of any key, only the cylindrical body portion 140 of pin one is exposed in the key slot 110, as illustrated in FIG. 7.

The foregoing described embodiments depict different components contained within, or connected with, different other components. It is to be understood that such depicted architectures are merely exemplary, and that in fact many other architectures can be implemented which achieve the same functionality. For example, key pins and drive pins need not be cylindrical, but could have other cross-sectional shapes, such as, by way of example, square or rectangular shapes. Furthermore, the key pins and driver pins illustrated in the embodiment of FIGS. 7-14 could include chamfered or beveled edges. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A lock mechanism comprising:

a cylinder housing having an aperture extending along a first axis of the cylinder housing and having a plurality of pin chambers in the cylinder housing aligned along the first axis and extending transverse to the first axis;

a cylinder plug positioned within the aperture and selectively rotatable therein about the first axis, the cylinder plug having a plurality of pin chambers aligned along the first axis and extending transverse to the first axis, the cylinder plug pin chambers being moved into alignment with corresponding ones of the cylinder housing pin chambers at which the lock mechanism is locked, the cylinder plug having a keyway passage extending along the first axis;

a key pin sized to slideably fit within each of the cylinder plug pin chambers, the key pins each having first and second ends and a selected length with at least some of the key pins having different lengths;

a driver pin sized to slideably fit within each of the cylinder housing pin chambers and extending into the corresponding ones of the cylinder plug pin chambers when the lock mechanism is locked, the driver pins abutting the first end of the respective key pin;

a spring sized to fit within each of the cylinder housing pin chambers and abut the respective driver pin to thereby resiliently urge the respective driver pin and the respective key pin toward the keyway passage;

an extension member extending at least partially into the keyway passage, the extension member forming a resting surface for the key pin second end, the key pins being in a resting position in abutment with the resting surface when the lock mechanism is locked to thereby prevent the key pin second ends from entering the keyway passage; and a key having a size and shape to permit insertion into the keyway passage, the key having a first end for insertion into the keyway passage and a plurality of activation portions along a longitudinal axis of the key corresponding to a respective pin chamber when the key is fully inserted to thereby align the first end portions of the key pins and permit rotation of the cylinder plug by rotation of the key, the key having a sloped leading edge for engagement with the key pins and an activation element at the key first end proximate the leading edge and configured to sequentially engage the key pins as the key is inserted into the keyway passage to thereby move the key pin from its resting position in abutment with the extension member resting surface to thereby expose the second end of the key pin in the keyway passage for engagement with the sloped leading edge of the key.

2. The mechanism of claim 1, further comprising a resilient member operationally coupled to the activation element to urge the activation element in a direction transverse to the longitudinal axis of the key and a plurality of apertures in the extension member in positions corresponding to respective ones of the key pins and sized to receive the activation element wherein the resilient member urges the activation element into contact with a key pin as the activation element aligns with the corresponding extension member aperture.

3. The mechanism of claim 1 wherein the extension member comprises a plurality of indentations extending along the extension member in positions corresponding to the key pins.

4. The mechanism of claim 3 wherein the second end portion of the key pins has a tapered end and the plurality of indentations has a taper corresponding to the tapered end of the key pins.

5. The mechanism of claim 1 wherein the activation element is a ball.

6. The mechanism of claim 1 wherein the extension member is positioned in the keyway passage to compress the activation element into a compressed position as the key is inserted into the keyway passage.

7. The mechanism of claim 6, further comprising a plurality of apertures in the extension member in positions corresponding to respective ones of the key pins and sized to receive the activation element wherein a resilient member urges the activation element out of the compressed position and into contact with a key pin as the activation element aligns with the corresponding extension member aperture.

8. The mechanism of claim 1 wherein the activation element is a magnetic element having a predetermined magnetic polar orientation and each of the plurality of key pins is magnetic with identical magnetic polar orientations with others of the key pins and different from the magnetic polar orientation of the magnetic activation element, the key pins being configured to permit magnetic activation of the key pins as the key is inserted into the keyway passage to thereby move the key pin from its resting position in the pin chamber by magnetic repulsion to thereby expose the second end portion of the key pin for engagement with the sloped leading edge of the key.

9. The mechanism of claim 8 wherein the extension member is non-magnetic.

10. The mechanism of claim 8, further comprising a recess in the extension member configured to receive the key pins wherein the resting surface is in the recess.

11. The mechanism of claim 8, further comprising a plurality of recesses in the extension member in positions corresponding to respective ones of the key pins wherein each of the plurality of recesses are configured to receive the corresponding key pin and wherein the resting surface is in the recess.

12. A lock mechanism having a cylinder housing with an aperture and a plurality of sliding pin members each having first and second ends, comprising:

a rotating member positioned within the aperture and selectively rotatable therein, the rotating member having a plurality of pin chambers aligned along a first axis and extending transverse to the first axis with at least a portion of the sliding pin members positioned therein, the cylinder plug having a keyway passage extending along the first axis and having a key entryway; and an extension member extending at least partially into the keyway passage and positioned to prevent the pin member second ends from exposure in the keyway passage.

13. The mechanism of claim 12 wherein the extension member includes a plurality of apertures in positions corresponding to respective ones of the plurality of pin chambers.

14. The mechanism of claim 12 wherein the extension member includes a plurality of indentations extending along the extension member in positions corresponding to the respective ones of the plurality of pin chambers.

15. The mechanism of claim 14 wherein the terminal portions of the sliding pin members are tapered and the plurality of indentations have a taper corresponding to the tapered terminal portion of the sliding pin members.

16. The mechanism of claim 12 wherein each of the plurality of sliding pin members is magnetic with identical magnetic polar orientations with others of the sliding pin members, each of the sliding pin members being configured for magnetic activation as a key is inserted into the keyway passage to thereby move the sliding pin member from a resting position in the pin chamber by magnetic repulsion to thereby expose the terminal portion of the sliding pin member for engagement with the key.

17. The mechanism of claim 16, further comprising a recess in the extension member configured to receive the sliding pin members wherein the terminal portion of the sliding pin members are positioned in the recess when the sliding pin member is in the resting position.

18. The mechanism of claim 12, further comprising a key having a size and shape to permit insertion of the key into the keyway passage, the key having a first end for insertion into the keyway passage and having a sloped leading edge for engagement with the terminal portion of the sliding pin members and an activation element at the key first end proximate the leading edge, the activation element being configured to sequentially activate each of the terminal portions of the sliding pin members to thereby expose the terminal portion of the sliding pin members for engagement with the sloped leading edge of the key.

19. The mechanism of claim 18 wherein the extension member includes a plurality of apertures in the extension member in positions corresponding to respective ones of the plurality of pin chambers and the activation element is configured to extend into the extension member apertures to mechanically engage the sliding pin members and expose the tapered terminal portion of the sliding pin members for engagement with the sloped leading edge of the key.

20. The mechanism of claim 18 wherein each of the plurality of sliding pin members is magnetic with identical magnetic polar orientations with others of the sliding pin members and the activation element is magnetic having a different magnetic polar orientation than the sliding pin members with each of the sliding pin members being configured for magnetic activation as the key is inserted into the keyway passage to thereby move the sliding pin member from a resting position in the pin chamber by magnetic repulsion to thereby expose the terminal portion of the sliding pin member for engagement with the key.

21. A key for activating a lock mechanism having a cylinder housing with an aperture and a plurality of sliding pin members having a terminal portion and a rotating member positioned within the aperture and selectively rotatable therein, the rotating member having a plurality of pin chambers aligned along a first axis and extending transverse to the first axis with at least a portion of the sliding pin members positioned therein, the cylinder plug having a keyway passage extending along the first axis and having a key entryway and an extension member extending at least partially into the keyway passage and positioned to block the pin member terminal portions from exposure in the keyway passage, the key comprising:

a handle portion, operable by a user, to control operation of the key;

an elongated insertion portion having first and second ends with the first end being coupled to the handle portion and the second end having a size and shape to permit insertion into the keyway passage, a pin positioning surface extending along a length of the elongated portion for positioning of the pin members; and an activation element at the key second end proximate the leading edge and positioned to sequentially engage each of the pin member terminal portions to thereby move the terminal portion of the sliding pin members into the keyway passage and expose the pin member terminal portion in the keyway passage for engagement with the pin positioning surface of the key.

22. The key of claim 21 for use with an extension member having a plurality of apertures in the extension member in positions corresponding to respective ones of the plurality of pin chambers wherein the activation element is sized to extend into the extension member apertures to engage and expose the tapered terminal portion of the sliding pin members for engagement with the sloped leading edge of the key.

23. The key of claim 22 wherein the activation element is a ball.

24. The key of claim 21, further comprising a resilient member operationally coupled to the activation element to urge the activation element in a direction transverse to a longitudinal axis of the key.

25. The key of claim 24 for use with an extension member having a plurality of apertures in positions corresponding to respective ones of the pin members, the activation element being sized to fit at least partially into the aperture wherein the resilient member urges the activation element into contact with the tapered terminal portion of the pin member as the activation element aligns with the corresponding extension member aperture.

26. The key of claim 21 wherein the activation element is compressed into a compressed position by the extension member as the key is inserted into the keyway passage.

27. The mechanism of claim 21 for use with a lock mechanism with each of the plurality of sliding pin members in the lock mechanism being magnetic with identical magnetic polar orientations with others of the sliding pin members wherein the activation element is magnetic having a different magnetic polar orientation than the sliding pin members wherein sequential engagement of each of the pin members terminal portions comprises magnetic activation of each of the sliding pin members as the insertion portion of the key is inserted into the keyway passage to thereby move the sliding pin member from a resting position in the pin chamber by magnetic repulsion to thereby expose the terminal portion of the sliding pin member for engagement with the pin positioning surface of the key.

28. A method of operating a lock mechanism having a cylinder housing with a rotating member positioned therein and a plurality of sliding pin members having a terminal portion comprising:

inserting a key into a key entry of the rotating member, the key having a plurality of activation portions along a pin positioning surface of the key;

activating a first of the plurality of sliding pin members to move the first sliding pin member from a resting position in which the terminal portion of the sliding pin member is not accessible in the key entry to an engagement position in which the terminal position of the sliding pin member is accessible in the key entry to thereby permit the pin positioning surface to engage the terminal portion of the first sliding pin member;

sequentially activating remaining ones of the plurality of sliding pin members to move the sliding pin members from the resting position to the engagement position; and if the key is the proper key for the lock mechanism, using the plurality of activation portions to align the plurality of sliding pin members at a position that permits rotation of the rotating member within the cylinder housing.

29. The method of claim 28 wherein activation of the plurality of sliding pin members comprises using a mechanical activation member in the key to mechanically move each of the plurality sliding pin members from the resting position to the engagement position.

30. The method of claim 28 wherein activation of the plurality of sliding pin members comprises using a magnetic activation member in the key to magnetically move each of the plurality sliding pin members from the resting position to the engagement position.

31. A lock mechanism having a cylinder housing with an aperture and a plurality of sliding pin members each having a terminal portion, comprising:

a rotating member positioned within the aperture and selectively rotatable therein;

a plurality of pin chambers aligned along a first axis and extending through the cylinder housing and partially extending into the rotating member with a sliding pin member positioned in each of the plurality of pin chambers;

a keyway passage extending along the first axis and having a key entryway; and an extension member extending at least partially into the keyway passage to form a shelf transverse to the plurality of pin chambers, the extension member extending from a location proximate the key entryway along the first axis to a location beyond the plurality of pin chambers wherein the terminal portions of the sliding pin members rest on the extension member to thereby prevent the terminal portions of the plurality of sliding pin members from being exposed in the keyway passage.

32. The mechanism of claim 31, further comprising a plurality of apertures in the extension member in positions aligned with respective ones of the plurality of pin chambers, the apertures being sized to prevent the terminal portions of the plurality of sliding pin members from being exposed in the keyway passage.

33. The mechanism of claim 32, further comprising a plurality of indentations in the extension member apertures on a side of the extension member opposing the plurality of pin chambers, each indentation being sized to receive the terminal portion of the sliding pin members wherein the terminal portion of each of the sliding pin members nests within the corresponding indentation.

34. The mechanism of claim 32, further comprising a key having a size and shape to permit insertion of the key into the keyway passage, the key having a first end for insertion into the keyway passage and having a sloped leading edge for engagement with the terminal portion of the sliding pin members and an activation element at the key first end proximate the leading edge, the activation element being configured to sequentially contact each of the terminal portions of the sliding pin members through the corresponding aperture to thereby move the sliding pin member from the position at rest on the extension member to thereby expose the terminal portion of the sliding pin members for engagement with the sloped leading edge of the key.

* * * * *